US007373888B1

(12) United States Patent
Namanny et al.

(10) Patent No.: US 7,373,888 B1
(45) Date of Patent: May 20, 2008

(54) DRAG RACE SIMULATOR

(76) Inventors: Kenneth D. Namanny, 1500 SW. 7th St., Atlantic, IA (US) 50022; Keith E. Namanny, 1500 SW. 7th St., Atlantic, IA (US) 50022; Kerry T. Namanny, 1500 SW. 7th St., Atlantic, IA (US) 50022

( * ) Notice: Subject to any disclaimer, the term of this patent is extended or adjusted under 35 U.S.C. 154(b) by 269 days.

(21) Appl. No.: 11/257,866

(22) Filed: Oct. 25, 2005

Related U.S. Application Data

(60) Provisional application No. 60/622,480, filed on Oct. 27, 2004.

(51) Int. Cl.
*A63G 29/00* (2006.01)

(52) U.S. Cl. ..... 104/60; 104/67

(58) Field of Classification Search ..... 104/53, 104/60, 67, 140, 165, 173.1, 202, 287; 105/238.1
See application file for complete search history.

(56) References Cited

U.S. PATENT DOCUMENTS 3,565,430 A * 2/1971 McRoskey ..... 463/59
3,606,328 A 9/1971 Delphia, Jr.
3,702,037 A * 11/1972 Toy et al. ..... 446/470
3,844,557 A * 10/1974 Pompetti ..... 446/444
4,991,514 A 2/1991 Powell et al. ..... 104/60
5,361,705 A 11/1994 Powell ..... 104/60
5,522,321 A 6/1996 Mosley et al. ..... 104/60
5,551,347 A 9/1996 Gutknecht ..... 104/53
5,562,522 A * 10/1996 Richno ..... 446/444
5,732,635 A * 3/1998 McKoy ..... 104/60
5,967,051 A 10/1999 Ragsdale et al. ..... 104/60
6,227,120 B1 5/2001 Fritz ..... 104/60
6,319,140 B1 11/2001 Mirfin et al. ..... 472/131
6,746,335 B2 6/2004 Kleimeyer et al. ..... 472/131
2003/0140815 A1 7/2003 Norbury

* cited by examiner

*Primary Examiner*—Lars A. Olson
(74) *Attorney, Agent, or Firm*—James D. Welch

(57) ABSTRACT

A system which simulates a dragster which exposes a driver to both "G" forces and "wheelies", and methodology of conducting a competition therewith.

28 Claims, 3 Drawing Sheets

DRAG RACE SIMULATOR

This Application Claims benefit of Provisional Application Ser. No. 60/622,480 Filed Oct. 27, 2004.

TECHNICAL FIELD

The disclosed invention relates to amusement rides, and more particularly to a simulated dragster cars which exposes a driver thereof to both "G" forces and the effects of a "wheelie" over a relatively short distance, including methodology of conducting a competition therewith.

BACKGROUND

With the present invention in mind a Search of patents was conducted. A patent to Fritz, No. 6,227,120 describes a simulate dragster which allows for varying numbers of participants to simultaneously experience a "wheelie". The system comprises motor driven rear wheels and means for adjusting the position of the front end of the chassis to compensate for passenger load. When the simulator is properly adjusted for the number of participants, and is caused to move along a track in excess of a predetermined acceleration, the front end raises off the track to simulate a "wheelie". Another U.S. Pat. No. 5,522,321 to Mosley et al, describes a simulated dragster with which are associated two bungee cords arranged such that the first thereof serves to cause acceleration, and the second thereof serves to cause deceleration. The track is sufficiently long that the acceleration bungee cord loses contact with the simulated dragster at about ¼ the length thereof. A Published patent Application by Norbury, No. US 2003/0140815 describes a real size simulated drag strip ride. The real-sized dragster is preferably powered by an induction motor, but for short rides this can be replaced by a bungee cord, a spring mechanism or by pneumatic powered drivers. A patent to Ragsdale et al. describes an amusement ride comprising a track that has a centering slot which guides a vehicle. The track also includes a plurality of sequentially oriented braking units near the end of the track. A patent to Powell et al., U.S. Pat. No. 4,991,514 describes an electromagnetically powered drag ride having a two land track. U.S. Pat. No. 6,319,140 to Mirfin et al. describes a spring based amusement device. Additional patents which were identified by are not felt to be particularly relevant are No. 5,361,705 to Powell which describes an arcade-type amusement game; U.S. Pat. No. 3,606,328 to Delphia, Jr. which describes a drag race simulator; and U.S. Pat. No. 6,746,335 to Kleimeyer et al., which describes use of springs in an amusement ride.

DISCLOSURE OF THE INVENTION

The present invention is a combination car and track, said track having a start and an end, said car being secured to said track such that accelerator elements can cause said car to accelerate along said track, beginning at said start thereof, and travel along its length, and said decelerator element being secured to said car such that it can cause said car to deccelerate along said track when said car is near the end thereof. Said track is of a length appropriate to fit on a flatbed truck, (eg. twenty-four (24) Feet long), atop which flatbed said combination car and track can be used, or, disassembled, the system can be otherwise transported.

The combination car and track is distinguished by at least one selection from the group consisting of:

said track is flared near said end thereof such that natural braking of said car occurs as a result of friction between the wheels and the track, as it approaches said end;

said accelerator element is firmly secured to said car such that it can cause said car to accelerate along said track beginning at said start thereof, and travel along its length;

said deccelerator element is firmly secured to said car such that it can cause said car to deccelerate along said track when said car is near the end thereof.

said car of said combination car and track is attached to said track via said reciprocating accelerator/decelerator elements which attach to the end and start of the track, respectively, said decelerator element being typically selected to be of a strength less than sufficient to fully absorb the kinetic energy of a car and cause it to come to a stop;

the car of said combination car and track is attached to said track by a strap which is of a length to stop said car before it reaches the end of said track;

said safety strap can be used as a winch strap when setting the car in position before its release;

the car of said combination car and track, can comprise a wheelie bar on the rear of the car to limit the magnitude of wheelie said car can perform;

said car of said combination car and track can comprise brake elements which prevent car motion when set, and allows car motion when released. said car of said combination car and track can further comprise heavily padded seats and a safety belt;

said track of said combination car and track can have a spring loaded barricade at the end thereof;

said track of said combination car and track can comprise a plurality of portable interconnecting sections;

said combination car and track can further comprise a control, said control console comprising simulated brake means for controlling the car, and optionally, means for simulating drag race sounds;

said combination car and track can further comprise a tree light bar at the end of said track and a control console, said control comprising means for controlling said tree light bar;

said tree light bar can have affixed there to a score board for indicating brake release times.

A method of providing a subject the experience of acceleration associated with a drag race, comprising the steps of:

a) providing a combination car and track, said track having a start and an end, said car being secured to said track such that said car can begin at said start thereof, and travel along its length;

said car being attached to said track via reciprocating accelerator/decelerator elements which attach to the end and start of the track, respectively, and said car further comprising brake means which prevents car motion when set, and allows car motion when released, said car motion being caused by the action of said reciprocating accelerator/decelerator elements which attach to the end and start of the track, respectively; said decelerator means being typically selected to be of a strength less than sufficient to fully absorb the kinetic energy of a car and cause it to come to a stop;

practicing steps b and c in either order:

b) causing a driver to be entered into said car;

c) orienting said car on said track so that it is near the start thereof and operating said brake means to secure it in place;

d) releasing the brake means;

to the end that it accelerates toward the end of the track.

Said combination car and track further comprising a tree light bar at the end of said track and a control for operating lights therein, and wherein said driver releases the brake means in response to lights thereon changing.

Said combination car and track can further comprise a control counsel for operating said brake means in response to an operator operating said control counsel. That is, in a variation of the preferred procedure, the driver does not control the release of the brake.

Another method of providing a driver the experience of drag racing, and determining a winner of a simulated drag race, comprising the steps of:

a) providing two systems, one of which comprises:

a combination car and track, said track having a start and an end, said car being secured to said track such that said car can begin at said start thereof, and travel along its length;

said car being attached to said track via reciprocating accelerator/decelerator elements which attach to the end and start of the track, respectively, and said car further comprising brake means which prevents car motion when set, and allows car motion when released, said car motion being caused by the action of said reciprocating accelerator/decelerator elements which attach to the end and start of the track, respectively, said decelerator element being typically selected to be of a strength less than sufficient to fully absorb the kinetic energy of a car and cause it to come to a stop; and the other of which is a control counsel comprising a simulated brake means;

said systems further comprising a tree light bar at the end of said tracks and a control counsel for operating lights therein;

b) causing a driver to be entered into said car, and causing another competitor to be located at the control counsel comprising said simulated brake means;

c) orienting said car on its track so that it is near the start thereof and operating said brake means to secure it in place;

d) operating lights of the tree light bar to indicate a start signal;

e) said driver and other competitor releasing the brake means as quickly as possible after the start signal, with a result being that said car accelerates toward the end of the track;

the winner of said simulated drag race being identified as the driver or other competitor who released the brake means or simulated brake means the fastest after the start signal.

A variation of this method provides that both competitors operate simulated brake means at control consoles, and that while at least one car is present on a track, that while it can, it need not contain a person. That is, the car can be empty.

Another method of providing two drivers the experience of drag racing, and determining a winner of a simulated drag race, comprising the steps of:

a) providing two systems, each comprising:

a combination car and track, said track having a start and an end, said car being secured to said track such that said car can begin at said start thereof, and travel along its length;

said car being attached to said track via reciprocating accelerator/decelerator elements which attach to the end and start of the track, respectively, and said car further comprising brake means which prevents-car motion when set, and allows car motion when released, said car motion being caused by the action of said reciprocating accelerator/decelerator elements which attach to the end and start of the track, respectively, said decelerator element being typically selected to be of a strength less than sufficient to fully absorb the kinetic energy of a car and cause it to come to a stop;

said systems further comprising a tree light bar at the end of said tracks and a control counsel for operating lights therein;

practicing steps b and c in either order:

b) causing a driver to be entered into each said car;

c) orienting said cars on their respective tracks so that they is near the start thereof and operating said brake means to secure them in place;

d) operating lights of the tree light bar to indicate a start signal;

d) said drivers releasing the brake means;

to the end that said cars accelerate toward the end of the track, the winner of said simulated drag race being identified as the driver who released the brake means the fastest after the start signal.

While not necessary, the methods can also include providing a display, for instance on the tree light bare that displays the times it took the competitors to release their brake means. The display can also be programmed to flash or blink to draw attention to the winning time.

The invention will be better understood by reading the Detailed Description in conjunction with the Drawings.

SUMMARY OF THE INVENTION

It is therefore a purpose and/or objective of the invention to teach a combination car and track, said car being firmly attached to said track via reciprocating acceleration and deceleration elements, and said car comprising a brake means to maintain the car motionless until when positioned at the start of said track, said brake is released to allow said acceleration means to cause said car to accelerate.

It is another purpose and/or objective of the invention to teach a combination car and track, wherein the track flares out at the end thereof such that friction is developed between said flared track and tires on said car when the car arrives at the end of said track.

It is yet another purpose and/or objective of the invention to teach a combination car and track which further comprises a control console, said control console comprising a simulated brake means.

It is another purpose and/or objective yet of the invention, to teach methodology for conducting competitions using two combination car and track systems or one combination car and track system and a control console or two control consoles, said car(s) and control console each comprising a direct or simulated brake means, respectively, wherein said competition involves rewarding the fastest operation of said brake means upon a signal to do so.

It is another purpose and/or objective of the Invention to teach conducting a competition using the system, wherein the winner is determined based on relative timing of brake release by a competitor after a start signal.

Other purposes and/or objectives of the invention will be apparent upon a reading of the Specification and Claims.

DETAILED DESCRIPTION

Figure 1:
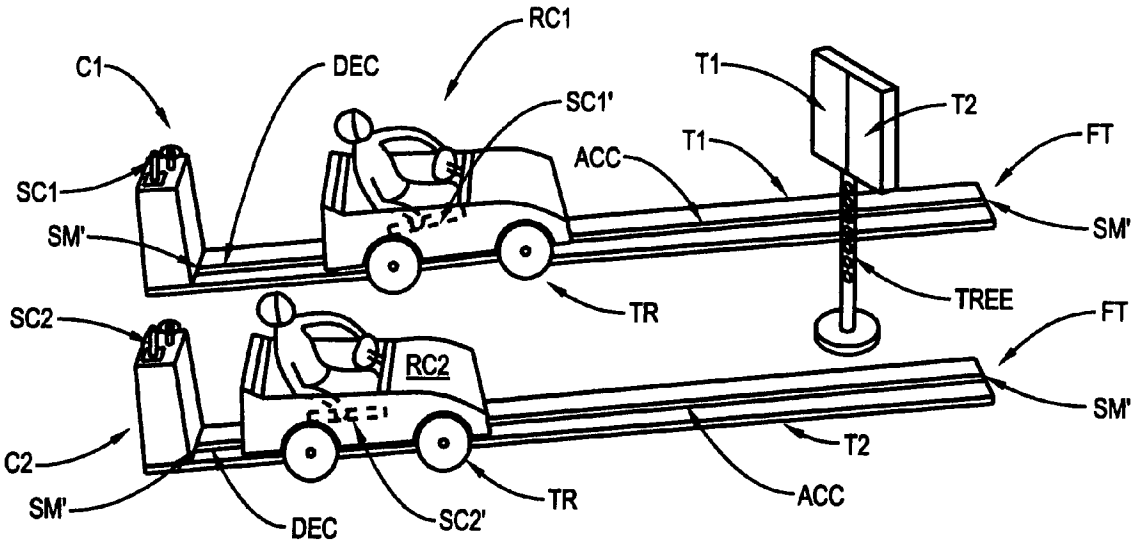
FIG. 1 shows a perspective view of two present invention car and track systems in use.
Figure 3:
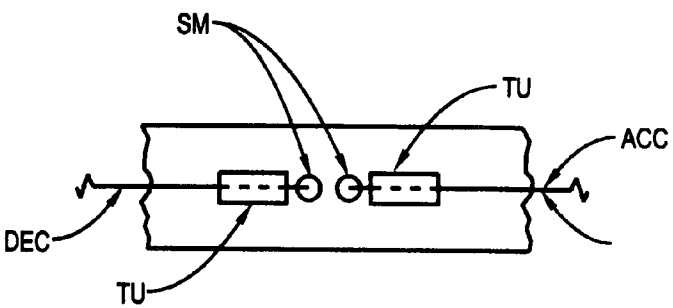
FIG. 3 shows a partial view of the bottom of a present invention car, indicating that the accelerator and decelerator elements are firmly secured thereto.

FIG. 1 shows perspective view of two present invention car and track systems in use. The first system has a Car (RC1) and Track (T1) shown functionally oriented with respect to one another. Also show is a Control Console (C1) which comprises a Brake Control Means (SC1). Note that Car (RC1) also comprises a Brake Control Means (SC1'). The Car (RC1) has Accelerator (ACC) and Decelerator (DEC) elements firmly attached thereto by Securing Means (SM) as shown by the partial bottom view thereof in FIG. 3 with respect to a general car designated as (RC). Note that the Securing Means (SM) further firmly connect the Deceleration (DEC) and Acceleration (ACC) element to the Start and End of the Track (T1), respectively. Also note that Tubes (TU) are typically present to guide (ACC) and (DEC) under the car. The second system provides a Car (RC2) and a Track (T2). Said second Car (RC2) comprises Brake Control Means (SC2'). Further shown are a Control Console (C2) which comprises Brake Control Means (SC2). Decceleration (DEC) and Acceleration (ACC) elements are shown as present and are firmly attached to the second Car (RC2) as shown in FIG. 3. And the Deceleration (DEC) and Acceleration (ACC) elements in the Second system are firmly attached to the Start and End of the Track (T2) by Securing Elements (SC'). Note that the "start" of the Tracks (T1) (T2) is taken to be near the Control Consoles (C1) (C2), and the ends thereof are where the Tracks (T1) (T2) flare (FT) out.

FIG. 1 also indicates that a Track (T1) (T2) can comprise a plurality of sections which are mated together. This feature allows a track of any length to be provided. Of course the length of a Safety Strap (SS), which is described with respect to FIG. 4 would, be have to be adjusted as well.

Figure 2:
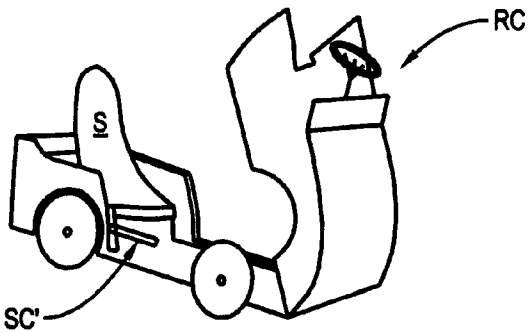
FIG. 2 shows a perspective view of a present invention car with the front opened to allow a person to enter.

FIG. 2 shows a demonstrative non-limiting design for a car (RC) showing that the front thereof can open to allow a person to enter. Importantly, also shown are a Seat (S), which can be heavily padded, and Brake Control Means (SC') oriented with respect to one another such that when a person sits in said Seat (S) it is easy to grasp and operate the Brake Control Means (SC'). FIG. 1 shows that at the instant captured the person in the First Car (RC1) had operated the Brake Control Means (SC') therein, while the person in the Second Car (RC2) had not. It should also be appreciated that the First Car (RC1) is in the midst of a "Wheelie" as a result, while the Second Car (RC2) has not yet moved forward.

It is to be understood that the Brake Control Means (SC') can be provided linkage that enables operation by a foot peddle or a lever positioned similar to a gear shifter, instead of hand controlled. The configuration shown in FIG. 2 is therefore to be viewed as demonstrative and not limiting. Any functional control means can be applied and remain in the scope of the claims.

It is to be understood that the Decceleration (DEC) and Acceleration (ACC) elements are preferably "bungee" cords, but that any "spring" providing means can be applied. Further, in FIG. 1 the Acceleration (ACC) element is stretched to the point that it overpowers any effect of the Decceleration (DEC) element and thus caused the First Car (RC1) to quickly accelerate forward as shown, when the Brake Means (SC2') was released. As the First Car (RC1) proceeds toward the end of the Track (T1), the Acceleration element (ACC) becomes progressively less influential, and the Deceleration (DEC) element becomes progressively more influential, thereby serving to slow the First Car. Further, another slowing effect is caused by frictional interaction between the track (T1), which Flares (FT) near the end thereof, and the insides of the front tires (TR). It is noted that the track could have an inward flare which would interact with the outer outsides of the tires and such is to be considered equivalent for the purposes of the Claims. In one embodiment, the Deceleration (DEC) means is not a strong as the Acceleration (ACC) element, as the Flare (FT) serves to aide with stopping the car at the end of a Track.

Also shown in FIG. 1 is a Light Bar Tree (TREE), which is similar to those used to initiate car races. In use a sequence of lights turning on/off indicates when it is allowable to begin racing. Said TREE can be operated from either Control Console (C1) (C2) or from some other location, or can be automated. Atop said Light Bar Tree (TREE) is shown a "Scoreboard" (T1) (T2). In use it is used to display the time required for the brakes to be released in cars (RC1) and (RC2) respectively. Note that the Scoreboard can be located other than atop the Light Bar Tree (TREE) and remain within the scope of the claims, although the positioning shown is preferred.

It is noted that in the set-up of FIG. 1 the people/contestants in the First (RC1) and Second (RC2) Cars can watch the sequence of lights on the TREE, and operate the Brake Control Means (SC1') and (SC2') to release the First (RC1) and Second (RC2) Cars respectively. FIG. 1 indicates that the drive of the First (RC1) Car "won" that "competition". It is also possible for only one the First (RC1) and Second (RC2) Cars to be occupied, say (RC1), and for a second "contestant" to operate the Brake Release (SC2) at the Second Control Console (SC2) for the other, Second (RC2) Car in response to the TREE signal to start. Thus a "competition" can be conducted between two people/contestants in cars, or between one person/contestant in a car and another person/contestant at a Control Console which is fitted with a simulated brake means. In addition, while not preferred, two people could operate Brake Releases at First and Second Control Consoles. Another embodiment provides that no Control Console operation be possible.

Figure 4:
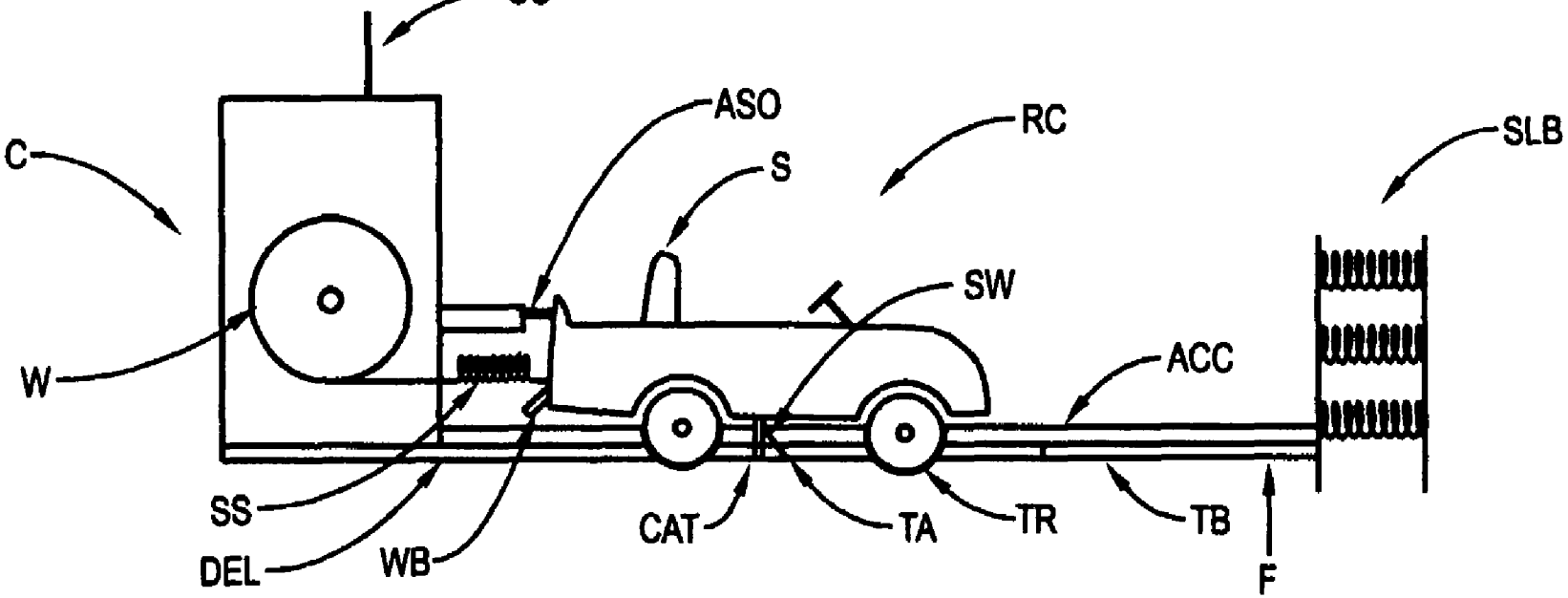
FIG. 4 shows various additional system elements which can comprise the present invention.
Figure 5:
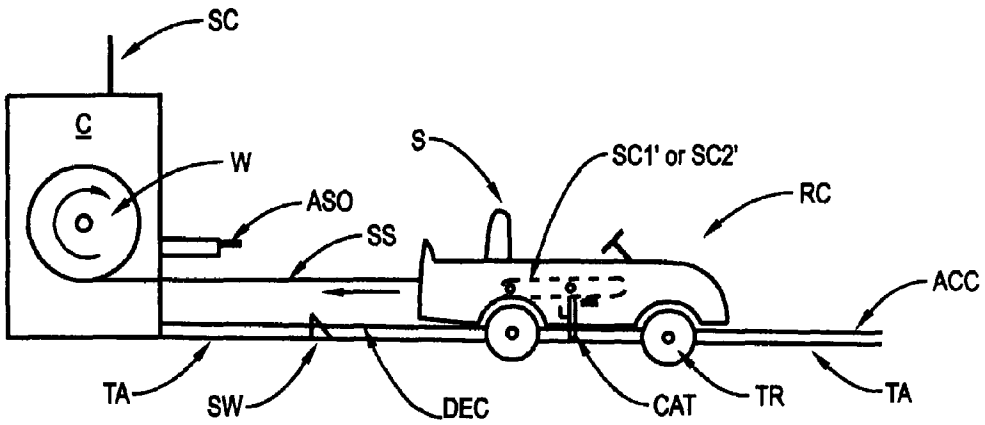
FIG. 5 provides more detail to the system shown in FIG. 1 near a Control Console.

FIG. 4 is included to show that Cars (RC) can have a "Wheelie-bar" (WB) attached to the back thereof to prevent the Car (RC) from tipping its nose too far upward during initial acceleration. FIG. 4 also shows a Safety Strap (SS) can be attached to Car (RC) which is just long enough to let the Car (RC) travel the length of the Track (eg. the sum of its sections Ta+Tb etc.), but not long enough to allow the Car (RC) to travel past and off the Track. Where the Track is 24 Feet long, the Safety Strap will be approximately 24 Feet less the length of the Car (RC). The system can also comprise a Spring Loaded Barrier (SLB) at the end of the Track such that if a Car (RC) does travel beyond the end thereof, it is brought to rest by colliding therewith. Said Safety Strap (SS) can be used as a means to pull the car to the left as shown, via application of a Winch (W). An alternative strap can also be applied. FIG. 5 shows the Winch (W) being used to pull a Car (RC) toward the Control Console (C) via Safety Strap (SS), which stretches the Acceleration (ACC) element. Note the presence of the Securing Wedge (SW) on the Track (TA) and Car Acceleration Trip (CAT) element in the Car (RC). Also note the presence of Automatic Switch (ASO). When the Car (RC) is pulled toward the Control Console (C) to be positioned as shown in FIG. 4, note that the Car Acceleration Trip (CAT) element is positioned behind the Securing Wedge (SW) to retain the Car (RC) as shown. Also note that Automatic Switch (ASO) is operated by contact with said Car (RC). Said Automatic Switch (ASO) controls the Winch (W) and when operated serves to stop it from further pulling said Car (RC) toward the Control Console (C). This same switch, or another that monitors the time at which the Winch (W) ceases to pull a Car (RC) toward the Control Console (C), can be used to control the triggering of the Sequence of lights on the Light Bar Tree (TREE). The Light Bar Tree (TREE) might be triggered by the achievement of appropriate positioning of the second Car (RC), for instance. In this light it should be understood that a contestant will typically enter a Car (RC) before it is pulled toward the Control Console (C) by the Winch (W). Said contestant will therefore be aware of the approaching point at which the Car (RC) is in position to be released. The contestant will be aware that the Light Bar Tree (TREE) is about to be triggered so that it provides a Start signal, and can ready him or herself to release the Brake Means associated with his or he Car (RC). Further, the circuitry can be arranged such that release of a Car (RC) before the Start signal is identified as a loss. However, once both cars (RC) are in place and a Start signal occurs, the first contestant to release the Brake Means associated with his or her Car (RC) will be identified as a winner.

Figure 6:
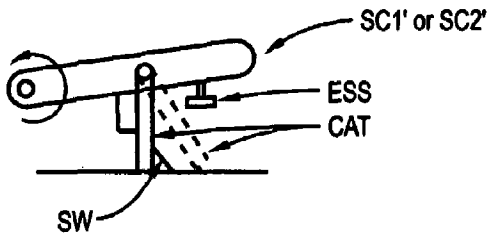
FIG. 6 provides detail regarding the Brake Control Means.

FIG. 6 shows more detail of the Brake Control Means (SC1') and (SC2') and related elements. Note that the Car Acceleration Trip (CAT) element is shown in dashed lines as rotated, and in solid lines as in place behind said Securing Wedge (SW) to retain as the Car (RC) in place as shown in FIG. 4. In the rotated position (CAT) can ride over the top of the Securing Wedge (SW), but once thereover it projects downward behind said Securing Wedge (SW). Note a demonstrative indication of the presence of an Electrical Switch (ESS). It is to be understood that the (ESS) can be in any functional location. Said Electrical Switch (ESS) provides signal to show operation of the Brake Control Means (SC1') or (SC2'), and is functionally connected to the Score Board (T1) (T2).

The present invention can also include at least one camera positioned to provide an image of the system or at least one contestant. For instance, a camera might be present on a car and used to capture the facial expression at the instant the Brake means is released. Another camera might be positioned to capture an image much as shown in FIG. 1 just after the instant of Brake Means release. A camera might also be positioned atop the Light Bar Tree (TREE), or at any other location.

It is noted that the terminology "car" can mean a vehicle of any body shape, including race car, motorcycle, truck and even fanciful shapes such as a boat or a boot etc.

It is also noted that the entire system can be cosmetically customized to promote a sponsor.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

We claim:

1. A combination car and track, said track having a start and an end, said car being secured to said track via accelerator and deccelerator elements which cause said car to accelerate from the start thereof and travel along its length and then slow down; said accelerator and decelerator elements being firmly attached to the end and start of the track, respectively, and to said car;

said combination car and track being distinguished in that it comprises a safety strap attached to said car which is of a length to stop said car before it reaches the end of said track.

2. A combination car and track as in claim 1, which is further characterized in that said track is flared near said end thereof such that natural braking of said car occurs as a result of friction between wheels affixed to said car, and the track, as said car approaches said end of the track.

3. A combination car and track as in claim 1, which car further comprises heavily padded seats and a safety belt.

4. A combination car and track as in claim 1, wherein said track comprises a plurality of portable interconnecting sections.

5. A combination car and track as in claim 1, which further comprises a tree light bar at the end of said track.

6. A combination car and track as in claim 1, which further comprises a control console, said control console comprising simulated brake means.

7. A combination car and track as in claim 6, in which said cars and/or control console comprises means for simulating drag race sounds.

8. A combination car and track as in claim 1, in which said car comprises brake means which prevents car motion when set, and allows car motion when released.

9. A combination car and track as in claim 1, in which said accelerator/deccelerator elements which firmly attach to the end and start of the track, respectively, and to said car are bungee cords.

10. A system as in claim 1 which further comprises at least one camera positioned at any functional location to provide an image of the system and/or a contestant.

11. A combination car and track as in claim 1, wherein said track is of a length appropriate to fit on a transport system to allow easy transport.

12. A combination car and track as in claim 11, wherein said track is 24 feet long.

13. A combination car and track, said track having a start and an end, said car being secured to said track via accelerator and decelerator elements which are attached to the end and start of the track, respectively;

said accelerator element being secured to said car such that it can cause said car to accelerate along said track, beginning at said start thereof, and travel along its length; and said decelerator element being secured to said car such that it can cause said car to deccelerate along said track near the end thereof;

said combination car and track being distinguished in that said car is firmly attached to said accelerator and decelerator elements which attach to the end and start of the track respectively;

said car and track further comprising at least one selection from the group consisting of:

a safety strap is attached to said car and the start of said track said safety strap being of a length to stop said car before it reaches the end of said track;

said track further comprises a spring loaded barricade at the end thereof; and said car further comprises a wheelie bar on the rear of the car to limit the magnitude of wheelie said car can perform.

14. A combination car and track as in claim 13, said combination car and track being further distinguished by at least one selection from the group consisting of:

said track is flared near said end thereof such that natural braking of said car occurs as a result of friction between the wheels and the track, as it approaches said end;

said combination car and track further comprises a winch which is attached to a strap attached to said car for use in pulling said car into position;

said combination car and track further comprises a spring loaded barricade at the end thereof;

said combination car and track further comprises heavily padded seats and a safety belt;

said combination car and track comprises a plurality of portable interconnecting sections;

said combination car and track further comprises a control console, said control console comprising simulated brake means;

said combination car and track further comprises a control console, said car and/or control console comprising means for causing simulation of drag racing sounds;

said combination car and track further comprises a tree light bar at the end of said track;

said combination car and track further comprises a score board atop the light bar at the end of said track;

said combination car and track further comprises a score board mounted at a location other than atop the light bar.

15. A system as in claim 13 which further comprises at least one camera positioned at any functional location to provide an image of the system and/or a contestant.

16. A method of providing a subject the experience of acceleration associated with a drag race, comprising the steps of:

a) providing a combination car and track, said track having a start and an end, said car being secured to said track such that said car can begin at said start thereof, and travel along its length;

said car being attached to said track via reciprocating accelerator/decelerator elements which attach to the end and start of the track, respectively, and said car further comprising brake means which prevents car motion when set, and allows car motion when released, said car motion being caused by the action of said reciprocating accelerator/decelerator elements which attach to the end and start of the track, respectively, said decelerator element being typically selected to be of a strength less than sufficient to fully absorb the kinetic energy of a car and cause it to come to a stop;

said combination car and track further comprising at least one selection from the group consisting of:

a safety strap is attached to said car and the start of said track, said safety strap being of a length to stop said car before it reaches the end of said track;

said track further comprises a spring loaded barricade at the end thereof; and said car further comprises a wheelie bar on the rear of the car to limit the magnitude of wheelie said car can perform;

practicing steps b and c in either order:

b) causing a driver to be entered into said car;

c) orienting said car on said track so that it is near the start thereof and operating said brake means to secure it in place;

d) releasing the brake means;

to the end that it accelerates toward the end of the track.

17. A method as in claim 16, in which said combination car and track further comprising a tree light bar at the end of said track and a control for operating lights therein, and wherein said driver releases the brake means in response to lights thereon changing.

18. A method as in claim 16, in which the step of providing a combination car and track further involves providing a control console for operating said brake means in response to an operator operating said control console.

19. A method as in claim 16, in which the step of providing said combination car and track additionally comprises at least one selection from the group consisting of:

said track is flared near said end thereof such that natural braking of said car occurs as a result of friction between the wheels and the track, as it approaches said end;

said combination car and track further comprises a winch which is attached to a strap attached to said car for use in pulling said car into position;

said combination car and track further comprises a spring loaded barricade at the end thereof;

said combination car and track further comprises heavily padded seats and a safety belt;

said combination car and track comprises a plurality of portable interconnecting sections;

said combination car and track further comprises a control console, said control console comprising simulated brake means;

said combination car and track further comprises a control console, said car and/or control console comprising means for causing simulation of drag racing sounds;

said combination car and track further comprises a tree light bar at the end of said track;

said combination car and track further comprises a score board atop the light bar at the end of said track;

said combination car and track further comprises a score board mounted at a location other than atop the light bar.

20. A method as in claim 16 which further comprises providing at least one camera positioned to provide an image of the system and/or a contestant.

21. A method of providing a driver the experience of drag racing, and determining a winner of a simulated drag race, comprising the steps of:

a) providing two systems, one of which comprises:

a combination car and track, said track having a start and an end, said car being secured to said track such that said car can begin at said start thereof, and travel along its length;

said combination car and track further comprising at least one selection from the group consisting of:

said car and track further comprises a safety strap attached to said car and the start of said track, said safety strap being of a length to stop said car before it reaches the end of said track;

said track further comprises a spring loaded barricade at the end thereof; and said car further comprises a wheelie bar on the rear of the car to limit the magnitude of wheelie said car can perform;

said car being attached to said track via reciprocating accelerator/decelerator elements which attach to the end and start of the track, respectively, and said car further comprising brake means which prevents car motion when set, and allows car motion when released, said car motion being caused by the action of said reciprocating accelerator/decelerator elements which attach to the end and start of the track, respectively, said decelerator element being typically selected to be of a strength less than sufficient to fully absorb the kinetic energy of a car and cause it to come to a stop; and the other of which is a control console comprising a simulated brake means;

said systems further comprising a tree light bar at the end of said tracks and a control console for operating lights therein;

b) causing a driver to be entered into said car, and causing another competitor to be located at the control console comprising said simulated brake means;

c) orienting said car on its track so that it is near the start thereof and operating said brake means to secure it in place;

d) operating lights of the tree light bar to indicate a start signal;

e) said driver and other competitor releasing the brake means as quickly as possible after the start signal, with a result being that said car accelerates toward the end of the track;

the winner of said simulated drag race being identified as the driver or other competitor who released the brake means or simulated brake means the fastest after the start signal.

22. A method as in claim 21 which further comprises providing at least one camera positioned to provide an image of the system and/or a contestant.

23. A method of providing two drivers the experience of drag racing, and determining a winner of a simulated drag race, comprising the steps of:

a) providing two systems, each comprising:

a combination car and track, said track having a start and an end, said car being secured to said track such that said car can begin at said start thereof, and travel along its length;

said combination car and track further comprising at least one selection from the group consisting of:

a safety strap is attached to said car and the start of said track, said safety strap being of a length to stop said car before it reaches the end of said track;

said track further comprises a spring loaded barricade at the end thereof; and said car further comprises a wheelie bar on the rear of the car to limit the magnitude of wheelie said car can perform;

said car being attached to said track via reciprocating accelerator/decelerator elements which attach to the end and start of the track, respectively, and said car further comprising brake means which prevents car motion when set, and allows car motion when released, said car motion being caused by the action of said reciprocating accelerator/decelerator elements which attach to the end and start of the track, respectively, said decelerator element being typically selected to be of a strength less than sufficient to fully absorb the kinetic energy of a car and cause it to come to a stop;

said systems further comprising a tree light bar at the end of said tracks and a control console for operating lights therein;

practicing steps b and c in either order:

b) causing a driver to be entered into each said car;

c) orienting said cars on their respective tracks so that they are near the start thereof and operating said brake means to secure them in place;

d) operating lights of the tree light bar to indicate a start signal;

d) said drivers releasing the brake means;

to the end that said cars accelerate toward the end of the track, the winner of said simulated drag race being identified as the driver who released the brake means the fastest after the start signal.

24. A method as in claim 23 which further comprises providing at least one camera positioned to provide an image of the system and/or a contestant.

25. A method of providing a driver the experience of drag racing, and determining a winner of a simulated drag race, comprising the steps of:

a) providing two systems, at least one of which comprises:

a combination car and track, said track having a start and an end, said car being secured to said track such that said car can begin at said start thereof, and travel along its length;

said combination car and track further comprising at least one selection from the group consisting of:

a safety strap is attached to said car and the start of said track, said safety strap being of a length to stop said car before it reaches the end of said track;

said track further comprises a spring loaded barricade at the end thereof; and said car further comprises a wheelie bar on the rear of the car to limit the magnitude of wheelie said car can perform;

said car being attached to said track via reciprocating accelerator/decelerator elements which attach to the end and start of the track, respectively, and said car further comprising brake means which prevents car motion when set, and allows car motion when released, said car motion being caused by the action of said reciprocating accelerator/decelerator elements which attach to the end and start of the track, respectively, said decelerator element being typically selected to be of a strength less than sufficient to fully absorb the kinetic energy of a car and cause it to come to a stop; and both of which comprise a control console comprising a simulated brake means;

said systems further comprising a tree light bar at the end of said tracks and a control console for operating lights therein;

b) causing competitors to be located at the control consoles comprising said simulated brake means;

c) operating lights of the tree light bar to indicate a start signal;

d) said competitors releasing the simulated brake means as quickly as possible after the start signal, with a result being that said at lest one car accelerates toward the end of the track;

the winner of said simulated drag race being identified as the competitor who released the simulated brake means the fastest after the start signal.

26. A method as in claim 25 which further comprises providing at least one camera positioned to provide an image of the system and/or a contestant.

27. A combination car and track, said track having a start and an end, said car being secured to said track via accelerator and deccelerator elements which cause said car to accelerate from the start thereof and travel along its length and then slow down; said accelerator and decelerator elements being firmly attached to the end and start of the track, respectively, and to said car;

said combination car and track being distinguished in that said track further comprises a spring loaded barricade at the end thereof.

28. A combination car and track, said track having a start and an end, said car being secured to said track via accelerator and deccelerator elements which cause said car to accelerate from the start thereof and travel along its length and then slow down; said accelerator and decelerator elements being firmly attached to the end and start of the track, respectively, and to said car;

said combination car and track being distinguished in that said car further comprises a wheelie bar on the rear of the car to limit the magnitude of wheelie said car can perform.

* * * * *